US011486597B2

(12) United States Patent
Chang et al.

(10) Patent No.: US 11,486,597 B2
(45) Date of Patent: Nov. 1, 2022

(54) CONTROL METHOD FOR AIR CONDITIONING SYSTEM

(71) Applicant: Chicony Power Technology Co., Ltd., New Taipei (TW)

(72) Inventors: Tse-Wen Chang, New Taipei (TW); Wen-Yen Cheng, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 293 days.

(21) Appl. No.: 16/836,480

(22) Filed: Mar. 31, 2020

(65) Prior Publication Data

US 2020/0318845 A1 Oct. 8, 2020

Related U.S. Application Data

(60) Provisional application No. 62/828,505, filed on Apr. 3, 2019.

(30) Foreign Application Priority Data

Mar. 9, 2020 (TW) ..... 109107736

(51) Int. Cl.
*F24F 11/63* (2018.01)
*F24F 11/87* (2018.01)
(Continued)

(52) U.S. Cl.
CPC ..... *F24F 11/63* (2018.01); *F24F 11/87* (2018.01); *F24F 2110/10* (2018.01);
(Continued)

(58) Field of Classification Search
CPC ..... F24F 11/63; F24F 11/87; F24F 2110/20; F24F 2110/12; F24F 2110/10
(Continued)

(56) References Cited

U.S. PATENT DOCUMENTS 10,222,081 B2 3/2019 Iwasaki
2007/0181701 A1* 8/2007 Cheng ..... F24F 11/83 236/49.3
(Continued)

FOREIGN PATENT DOCUMENTS

CN 1664524 A 9/2005
CN 101813361 A 8/2010
(Continued)

OTHER PUBLICATIONS

Lee et al., The new generation of industrial intelligence, Apr. 30, 2017, Shanghai Jiao Tong University Press pp. 129-133, tables 5-4, 5-5.
(Continued)

*Primary Examiner* — Md Azad
(74) *Attorney, Agent, or Firm* — Innovation Capital Law Group, LLP; Vic Lin

(57) ABSTRACT

A control method for an air conditioning system includes: calculating an average heat exchange amount of a coil according to real-time operation information; setting a full-load air volume parameter and a full-load water volume parameter in a heat exchange model according to the real-time operation information and the heat exchange model, and calculating a full-load heat exchange amount; calculating a dynamic margin value based on the average heat exchange amount and the full-load heat exchange amount; determining whether the dynamic margin value is greater than a first preset condition or less than a second preset condition, so that the controller outputs a first control signal or a second control signal respectively to adjust a coil water inlet temperature; and when the dynamic margin value is less than the first preset condition and greater than the second preset condition, maintaining the current setting state.

10 Claims, 3 Drawing Sheets

(51) Int. Cl.
*F24F 140/12* (2018.01)
*F24F 110/10* (2018.01)
*F24F 110/20* (2018.01)
*F24F 140/20* (2018.01)

(52) U.S. Cl.
CPC ..... *F24F 2110/20* (2018.01); *F24F 2140/12* (2018.01); *F24F 2140/20* (2018.01)

(58) Field of Classification Search
USPC ..... 700/276
See application file for complete search history.

(56) References Cited

U.S. PATENT DOCUMENTS

2010/0241287 A1* 9/2010 Nishino ..... F24F 3/065 62/160
2012/0078424 A1 3/2012 Raghavachari
2012/0221150 A1 8/2012 Arensmeier
2012/0245968 A1 9/2012 Beaulieu et al.
2014/0277767 A1* 9/2014 Othman ..... G05D 23/1917 700/278
2015/0057812 A1* 2/2015 Zhao ..... F24F 11/62 165/11.1
2015/0134123 A1 5/2015 Obinelo
2015/0159887 A1* 6/2015 Kadah ..... F24D 19/1084 126/116 A
2016/0025578 A1 1/2016 Meirav et al.
2016/0258695 A1* 9/2016 Akhavi ..... F28C 1/04
2017/0167747 A1* 6/2017 Zhang ..... F24F 3/048
2017/0212487 A1 7/2017 Gupta et al.
2019/0316798 A1 10/2019 Kokugan et al.

FOREIGN PATENT DOCUMENTS

CN 101896773 A 11/2010
CN 101988867 A 3/2011
CN 102147146 A 8/2011
CN 102521498 A 6/2012
CN 102759237 A 10/2012
CN 102865643 A 1/2013
CN 103019135 A 4/2013
CN 103776129 A 5/2014
CN 104236015 A 12/2014
CN 104456852 A 3/2015
CN 104990222 A 10/2015
CN 105091097 A 11/2015
CN 207438828 U 6/2018
CN 108253514 A 7/2018
CN 109099552 A 12/2018
CN 110195950 A 9/2019
TW 200951380 A 12/2009
TW 201215823 A 4/2012
TW 201248095 A 12/2012

OTHER PUBLICATIONS

Atlas of Modern Intelligent Building Systems Design, Construction Technology and Engineering., Lu Gongcheng, p. 504-508, China Architecture Publishing House, May 31, 2005.

* cited by examiner

CONTROL METHOD FOR AIR CONDITIONING SYSTEM

CROSS-REFERENCES TO RELATED APPLICATIONS

This application claims the priority benefit of U.S. provisional application Ser. No. 62/828,505, filed on Apr. 3, 2019 and Patent Application No. 109107736 filed in Taiwan, R.O.C. on Mar. 9, 2020. The entirety of the above-mentioned patent applications are hereby incorporated by references herein and made a part of the specification.

BACKGROUND

Technical Field

The present disclosure relates to a control method, and in particular, to a control method for an air conditioning system.

Related Art

An air conditioning device cools, dehumidifies or heats an indoor air conditioning area mainly through a coil heat exchanger. In an existing parameter design, a heat exchange capacity is usually calculated and a specification is usually defined according to a maximum load designing condition. However, during actual operation, both a temperature and a flow of a liquid fluid entering the coil heat exchanger and a temperature and a flow of a gaseous fluid outside a coil affect the heat exchange capacity of the coil heat exchanger.

Currently, heat exchange amounts are mostly calculated by multiplying an inlet-outlet temperature difference by a flow of a liquid fluid in a coil (a heat exchanger). In this manner, only a current heat exchange amount can be grasped, but benefits of subsequent optimized control cannot be provided.

SUMMARY

The present disclosure provides a control method for an air conditioning system. The control method for an air conditioning system is applied to an air handling unit (AHU) having a controller, a coil, a fan, and a plurality of detectors configured to detect real-time operation information of the coil, and includes: calculating, by the controller, an average heat exchange amount of the coil according to the real-time operation information; setting a full-load air volume parameter and a full-load water volume parameter in a heat exchange model according to the real-time operation information and the heat exchange model, and calculating, by the controller, a full-load heat exchange amount; calculating a dynamic margin value based on the average heat exchange amount and the full-load heat exchange amount; determining whether the dynamic margin value is greater than a first preset condition or less than a second preset condition, wherein the first preset condition is greater than the second preset condition; when the dynamic margin value is greater than the first preset condition, the controller outputs a first control signal to adjust a coil water inlet temperature of the coil; when the dynamic margin value is less than the second preset condition, the controller outputs a second control signal to adjust the coil water inlet temperature of the coil; and when the dynamic margin value is less than the first preset condition and greater than the second preset condition, the controller maintains a current setting state.

In some embodiments, the real-time operation information includes a coil inlet-outlet water temperature difference, a coil inlet-outlet water pressure difference, an air inlet temperature and humidity, an air inlet volume, a coil water inlet flow, and the coil water inlet temperature.

In some embodiments, the step of calculating the average heat exchange amount further includes: setting a preset time period and a preset number of times; calculating and recording each current heat exchange amount according to the real-time operation information after each preset time period; and after the preset number of times is reached, calculating an average value of all of the recorded current heat exchange amounts as the average heat exchange amount.

In some embodiments, the heat exchange model is created based on an original performance parameter and an environment parameter of the coil. The environment parameter includes an air inlet wet-bulb temperature, an absolute humidity, an enthalpy value, and a dew point temperature.

In some embodiments, when the dynamic margin value is greater than the first preset condition, during cooling-supply operation of the air handling unit, the controller increases the coil water inlet temperature according to the first control signal; and during heating-supply operation of the air handling unit, the controller reduces the coil water inlet temperature according to the first control signal.

In some embodiments, when the dynamic margin value is less than the second preset condition, during cooling-supply operation of the air handling unit, the controller reduces the coil water inlet temperature according to the second control signal; and during heating-supply operation of the air handling unit, the controller increases the coil water inlet temperature according to the second control signal.

In some embodiments, when the dynamic margin value is less than the second preset condition, the controller may further output a third control signal to control a damper of the air handling unit to reduce an opening degree of the damper.

In some embodiments, the full-load air volume parameter includes a maximum coil air inlet volume; and the full-load water volume parameter includes a maximum coil water inlet flow.

In some embodiments, the step of the controller maintains the current setting state further includes: maintaining the air inlet volume, the coil water inlet flow, and the coil water inlet temperature unchanged.

Therefore, in the present disclosure, a dynamic margin value can be obtained according to the average heat exchange amount and the full-load heat exchange amount, so as to grasp a heat exchange amount and a dynamic margin value of the air handling unit in various operating conditions in real time, thereby providing subsequent optimized linkage control.

DETAILED DESCRIPTION

Figure 1:
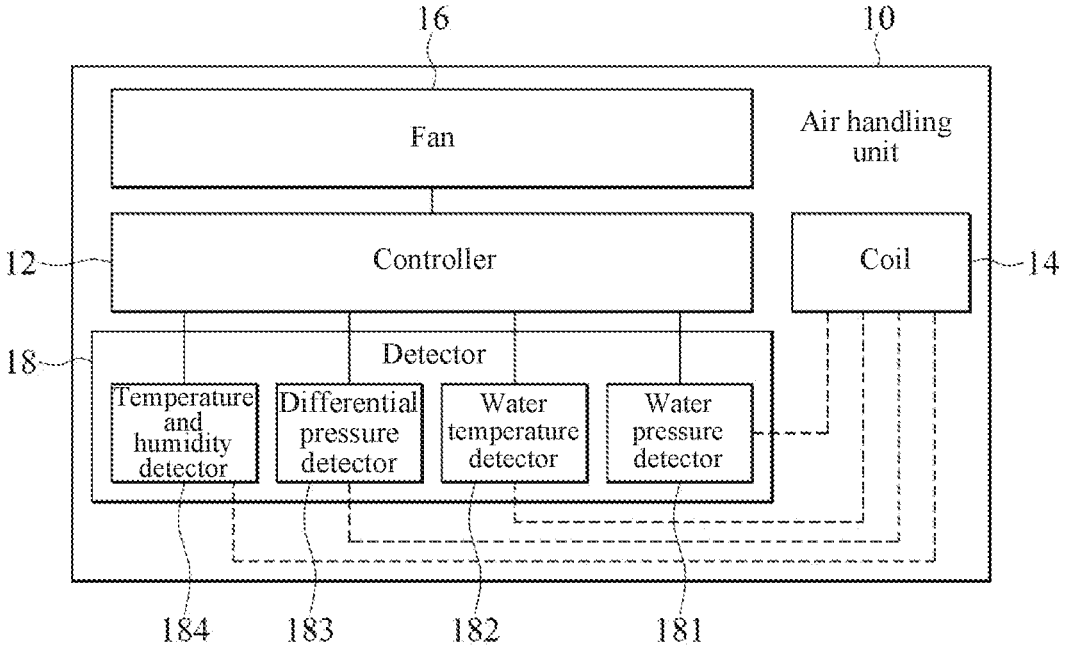
FIG. 1 is a block diagram of an air handling unit according to an embodiment of the present disclosure.

FIG. 1 is a block diagram of an air handling unit according to an embodiment of the present disclosure. Referring to FIG. 1, an air handling unit 10 includes a controller 12, a coil 14, a fan 16, and a plurality of detectors 18. The controller 12 is electrically connected to the fan 16 and the detectors 18. The detectors 18 are configured to detect real-time operation information of the coil 14. The real-time operation information includes a coil inlet-outlet water temperature difference, a coil inlet-outlet water pressure difference, an air inlet temperature and humidity, an air inlet volume, a coil water inlet flow, and a coil water inlet temperature. In an embodiment, the detector 18 includes a water pressure detector 181, a water temperature detector 182, a differential pressure detector 183, and a temperature and humidity detector 184. The water pressure detector 181 is configured to detect water pressures at an inlet and an outlet of the coil 14 to obtain the coil inlet-outlet water pressure difference and the coil water inlet flow. The water temperature detector 182 is configured to detect water temperatures at the inlet and the outlet of the coil 14 to obtain the coil inlet-outlet water temperature difference and the coil water inlet temperature. The differential pressure detector 183 is configured to sense a differential pressure of the coil 14 to obtain the air inlet volume of the coil 14. The temperature and humidity detector 184 is configured to sense a temperature and a humidity of an air inlet of the coil 14 to obtain the air inlet temperature and humidity. The air inlet temperature and humidity include a corresponding dry-bulb temperature and relative humidity. The coil 14 is a medium apparatus for heat exchange between a gaseous fluid and a liquid fluid. Therefore, a geometric design (including physical parameters such as a heat transfer material, a shape, an area, etc.) of the coil 14 and parameters of the gaseous fluid and the liquid fluid affect a heat exchange capacity. However, in actual application, all of the geometric design parameters of the coil 14 are fixed. Therefore, the heat exchange capacity of the coil can be calculated merely with real-time operation information of the gaseous fluid and the liquid fluid.

Figure 2:
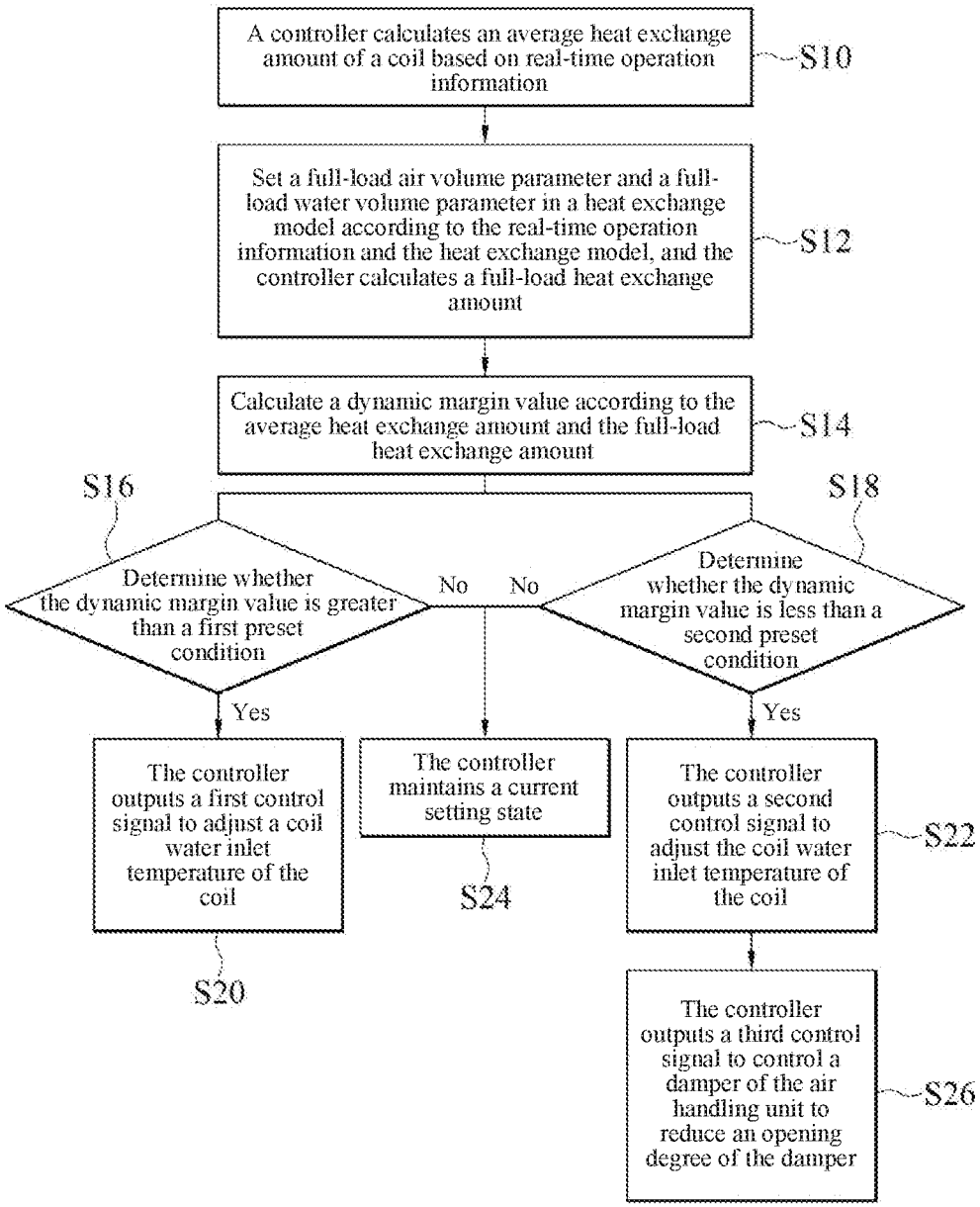
FIG. 2 is a schematic flowchart of a control method for an air conditioning system according to an embodiment of the present disclosure.

FIG. 2 is a schematic flowchart of a control method for an air conditioning system according to an embodiment of the present disclosure. Referring to both FIG. 1 and FIG. 2, the control method for an air conditioning system is applied to the air handling unit 10 shown in FIG. 1. The control method includes the following steps. First, as shown in step S10, the controller 12 calculates an average heat exchange amount of the coil 14 based on the real-time operation information. In an embodiment, the real-time operation information includes a coil inlet-outlet water temperature difference and a coil inlet-outlet water pressure difference.

Figure 3:
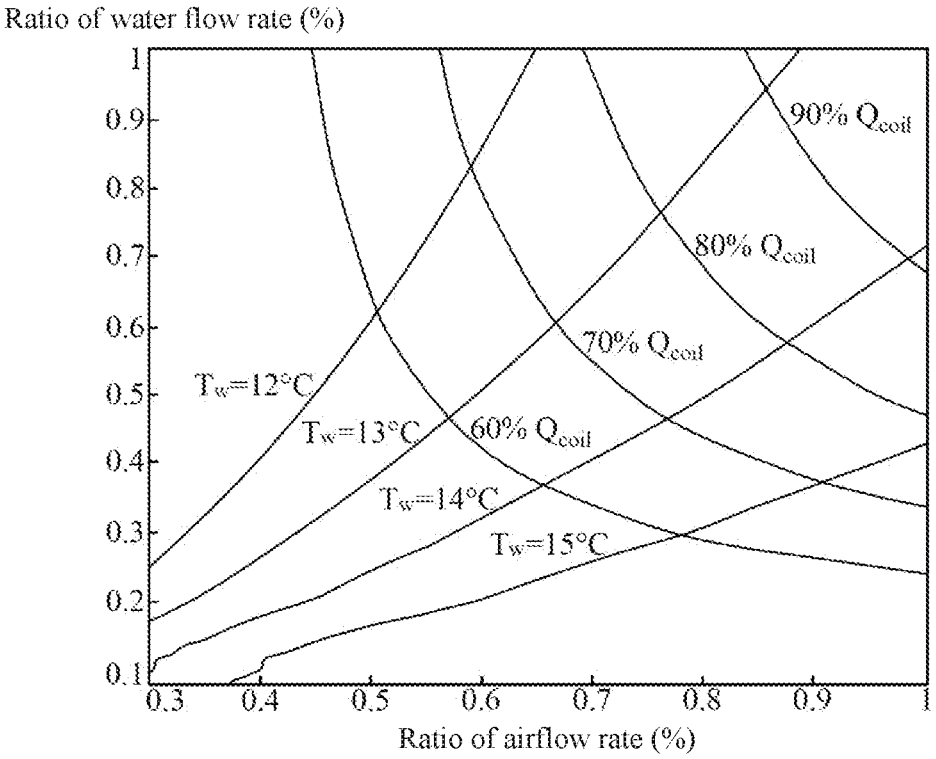
FIG. 3 is a schematic diagram of a parameter relationship curve of a coil according to the present disclosure.

As shown in step S12, a full-load air volume parameter and a full-load water volume parameter are set in a heat exchange model according to the real-time operation information and the heat exchange model, and the controller 12 calculates a full-load heat exchange amount. In an embodiment, the real-time operation information includes an air inlet temperature and humidity (including a dry-bulb temperature and a relative humidity), an air inlet volume, a coil water inlet flow, and a coil water inlet temperature. In an embodiment, the heat exchange model is created based on an original performance parameter and an environment parameter of the coil 14. The environment parameter includes an air inlet wet-bulb temperature, an absolute humidity, an enthalpy value, and a dew point temperature. The air inlet wet-bulb temperature depends on the air inlet temperature and humidity. In an embodiment, the original performance parameters used in the present disclosure are shown by a reference curve representing the relation between the parameters of the coil 14 in a particular design of geometric and material parameters in FIG. 3. The original performance parameter is provided by a manufacturer of the coil 14. In an embodiment, the heat exchange model further includes a formula for calculating a full-load heat exchange capacity. The formula for calculating the full-load heat exchange capacity is $C1*m_{water}+C2*m_{air}+C3*T_{air}+C4*RH_{air}+C5*T_w+C6$. The $m_{water}$ is a coil water inlet flow, $m_{air}$ is an air inlet volume, $T_{air}$ is a dry-bulb temperature, $RH_{air}$ is a relative humidity, $T_w$ is a coil water inlet temperature, and C1-C6 are regression coefficients. In addition, when the controller 12 calculates the full-load heat exchange capacity using the formula for calculating the full-load heat exchange capacity, the coil water inlet flow $m_{water}$ is set to a maximum coil water inlet flow $m_{water_100\%}$ of the full-load water volume parameter, and $m_{air}$ is set to a maximum air inlet volume $m_{air_100\%}$ of the full-load air volume parameter, to obtain the full-load heat exchange amount $C1*m_{water_100\%}+C2*m_{air_100\%}+C3*T_{air}+C4*RH_{air}+C5*T_w+C6$.

As shown in step S14, a dynamic margin value is calculated according to the average heat exchange amount and the full-load heat exchange amount. Specifically, the controller 12 performs calculation according to a margin calculation formula. The margin calculation formula is as follows: (full-load heat exchange amount−average heat exchange amount)/full-load heat exchange amount, so as to calculate the dynamic margin value accordingly.

As shown in steps S16 and S18, the controller 12 determines whether the dynamic margin value is greater than a first preset condition or determines whether the dynamic margin value is less than a second preset condition. The first preset condition is greater than the second preset condition. In an embodiment, the first preset condition is 25%, and the second preset condition is 20%.

When the dynamic margin value is greater than the first preset condition, as shown in step S20, the controller 12 outputs a first control signal to adjust a coil water inlet temperature of the coil 14, to provide an energy-saving operation strategy for the air handling unit 10. Specifically, when the dynamic margin value is greater than the first preset condition, during cooling-supply operation of the air handling unit 10, the controller 12 sends the first control signal to a cooling system (not shown) to increase a water supply temperature, so as to increase the coil water inlet temperature, thereby reducing energy consumption of the operation. During heating-supply operation of the air handling unit 10, the controller 12 sends the first control signal to a heating system (not shown) to reduce the water supply temperature, so as to reduce the coil water inlet temperature, thereby reducing the energy consumption.

When the dynamic margin value is less than the second preset condition, as shown in step S22, the controller 12 outputs a second control signal to adjust the coil water inlet temperature of the coil 14, to provide a comfort operation strategy for the air handling unit 10, thereby preventing environmental comfort from decreasing as a result of an insufficient heat exchange capacity of the coil 14. Specifically, when the dynamic margin value is less than the second preset condition, during cooling-supply operation of the air handling unit 10, the controller 12 sends the second control signal to the cooling system (not shown) to reduce a water supply temperature, so as to reduce the coil water inlet temperature. During heating-supply operation of the air handling unit 10, the controller 12 sends the second control signal to the heating system (not shown) to increase the water supply temperature, so as to increase the coil water inlet temperature. In an embodiment, in the operation strategy for improving comfort (the dynamic margin value is less than the second preset condition), as shown in step S26, the controller 12 may further output a third control signal for controlling a damper (not shown) of the air handling unit 10 to reduce an opening degree of the damper, thereby reducing a load of the air handling unit and increasing the margin value.

When the dynamic margin value is less than the first preset condition and greater than the second preset condition (determining results in step S16 and step S18 are both no), as shown in step S24, the controller 12 maintains a current setting state and does not provide an optimization control strategy, to maintain the air inlet volume, the coil water inlet flow, and the coil water inlet temperature unchanged.

Figure 4:
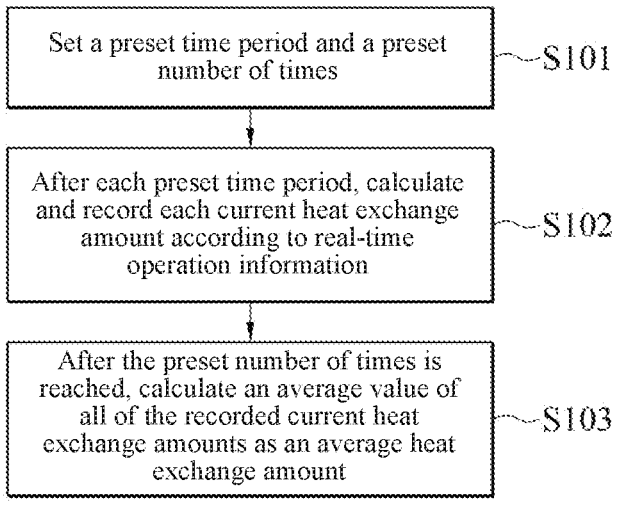
FIG. 4 is a schematic flowchart of obtaining an average heat exchange amount according to an embodiment of the present disclosure.

In an embodiment, as shown in FIG. 1 and FIG. 4, the step of calculating the average heat exchange amount further includes the following steps. As shown in step S101, the controller 12 sets a preset time period and a preset number of times. As shown in step S102, after each preset time period, the controller 12 calculates and records each current heat exchange amount according to the real-time operation information of the coil inlet-outlet water temperature difference and the coil inlet-outlet water pressure difference. As shown in step S103, after calculation times reach the preset number of times, the controller 12 calculates an average value of all of the recorded current heat exchange amounts as the average heat exchange amount. In an embodiment, the controller 12 calculates each current heat exchange amount using a formula for calculating an actual heat exchange capacity. The formula for calculating the actual heat exchange capacity is $Qcoil=\Delta T*Cp*m_w$. Qcoil is a heat exchange capacity of a current heat exchange amount, $\Delta T$ is a coil inlet-outlet water temperature difference, Cp is a specific heat, and $m_w$ is a flow. In addition, in actual application, the flow $m_w$ is calculated using the coil inlet-outlet water pressure difference between an inlet and an outlet of the coil 14. A formula for the flow is $m_w=C1*\Delta P^2+C2*\Delta P+C3$. $\Delta P$ is a coil inlet-outlet water pressure difference, and C1-C3 are regression coefficients. Therefore, each current heat exchange amount Qcoil of the coil 14 after each preset time period may be calculated using real-time operation information of the measured coil inlet-outlet water temperature difference $\Delta T$ and coil inlet-outlet water pressure difference $\Delta P$, and then all current heat exchange amounts Qcoil are added up and then divided by the preset number of times, so that the average heat exchange amount can be obtained.

Accordingly, in the present disclosure, a heat exchange model is built in the controller of the air handling unit. When the air handling unit is in a dynamic working condition (including the real-time operation information of the air inlet temperature and humidity and the coil water inlet temperature), the controller may automatically calculate a full-load heat exchange capacity when the air inlet volume and the coil water inlet flow are set to a full-load condition, and then calculate the dynamic margin value of the air handling unit based on real-time average heat exchange amount. The controller may provide benefits of subsequent optimized linkage control after obtaining the dynamic margin value of the coil. For example, when the controller learns, according to a calculation result, that the coil is operating in a high margin state for a long time, the method may be used to actively notify a user that a fluid supply temperature (a coil water inlet temperature) of a cooling system may be increased or that a fluid supply temperature of a heating system may be reduced to reduce energy consumption. Alternatively, the method may use the controller to automatically increase the fluid supply temperature of the cooling system or reduce the fluid supply temperature of the heating system to reduce energy consumption. On the contrary, when the controller learns that the coil is operating in a low margin state for a long time, the method may be used to actively notify the user that the fluid supply temperature (the coil water inlet temperature) of the cooling system may be reduced or that the fluid supply temperature of the heating system may be increased to maintain indoor comfort. Alternatively, the method may use the controller to automatically reduce the fluid supply temperature of the cooling system or increase the fluid supply temperature of the heating system to maintain indoor comfort.

The method disclosed herein includes a plurality of steps or actions for implementing the method. Without departing from the scope of the application, the steps in the foregoing method may be interposed with each other. For example, in the flowchart shown in FIG. 2, step S10 and step S12 may be interposed with each other. In other words, obtaining the average heat exchange amount or the full-load heat exchange amount first does not affect subsequent calculation. The subsequent calculation of step S14 may still be performed without being affected by the interposed steps.

In summary, in the present disclosure, a dynamic margin value can be obtained according to the average heat exchange amount and the full-load heat exchange amount, so as to grasp a heat exchange amount and a dynamic margin value of the air handling unit in various operating conditions in real time, thereby providing subsequent optimized linkage control. In addition, the calculated heat exchange capacity and dynamic margin value may also be used as an important reference for a future design change and review of the heat exchange capacity of the air conditioning device.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A control method for an air conditioning system, the control method for an air conditioning system being applied to an air handling unit having a controller, a coil, a fan, and a plurality of detectors configured to detect a real-time operation information of the coil, and comprising:

calculating, by the controller, an average heat exchange amount of the coil according to the real-time operation information;

setting a full-load air volume parameter and a full-load water volume parameter in a heat exchange model according to the real-time operation information and the heat exchange model, and calculating, by the controller, a full-load heat exchange amount;

calculating a dynamic margin value based on a margin calculation formula, and the margin calculation formula is (full-load heat exchange amount−average heat exchange amount)/full-load heat exchange amount;

determining whether the dynamic margin value is greater than a first preset condition or less than a second preset condition, wherein the first preset condition is greater than the second preset condition;

when the dynamic margin value is greater than the first preset condition, the controller outputs a first control signal to adjust a coil water inlet temperature of the coil;

when the dynamic margin value is less than the second preset condition, the controller outputs a second control signal to adjust the coil water inlet temperature of the coil; and when the dynamic margin value is less than the first preset condition and greater than the second preset condition, the controller maintains a current setting state.

2. The control method for an air conditioning system according to claim 1, wherein the real-time operation information comprises a coil inlet-outlet water temperature difference, a coil inlet-outlet water pressure difference, an air inlet temperature and humidity, an air inlet volume, a coil water inlet flow, and the coil water inlet temperature.

3. The control method for an air conditioning system according to claim 1, wherein the step of calculating the average heat exchange amount further comprises:

setting a preset time period and a preset recording times;

calculating and recording each current heat exchange amount according to the real-time operation information after each preset time period; and after the preset recording times is reached, calculating an average value of all of the recorded current heat exchange amounts as the average heat exchange amount.

4. The control method for an air conditioning system according to claim 1, wherein the heat exchange model is created based on an original performance parameter and an environment parameter of the coil.

5. The control method for an air conditioning system according to claim 4, wherein the environment parameter comprises an air inlet wet-bulb temperature, an absolute humidity, an enthalpy value, and a dew point temperature.

6. The control method for an air conditioning system according to claim 1, wherein when the dynamic margin value is greater than the first preset condition, the step of adjusting the coil water inlet temperature further comprises:

during cooling-supply operation of the air handling unit, the controller increases the coil water inlet temperature according to the first control signal; and during heating-supply operation of the air handling unit, the controller reduces the coil water inlet temperature according to the first control signal.

7. The control method for an air conditioning system according to claim 1, wherein when the dynamic margin value is less than the second preset condition, the step of adjusting the coil water inlet temperature further comprises:

during cooling-supply operation of the air handling unit, the controller reduces the coil water inlet temperature according to the second control signal; and during heating-supply operation of the air handling unit, the controller increases the coil water inlet temperature according to the second control signal.

8. The control method for an air conditioning system according to claim 7, wherein when the dynamic margin value is less than the second preset condition, the controller may further output a third control signal to control a damper of the air handling unit to reduce an opening degree of the damper.

9. The control method for an air conditioning system according to claim 1, wherein the full-load air volume parameter comprises a maximum coil air inlet volume; and the full-load water volume parameter comprises a maximum coil water inlet flow.

10. The control method for an air conditioning system according to claim 2, wherein the step of the controller maintains the current setting state further comprises: maintaining the air inlet volume, the coil water inlet flow, and the coil water inlet temperature unchanged.

* * * * *